US011338570B2

(12) United States Patent
Moore et al.

(10) Patent No.: US 11,338,570 B2
(45) Date of Patent: May 24, 2022

(54) SHEET DETECTION CIRCUIT USING ELECTRICAL ELEMENTS CONTACTING CONDUCTIVE VACUUM BELT

(71) Applicant: Xerox Corporation, Norwalk, CT (US)

(72) Inventors: Aaron M. Moore, Fairport, NY (US); Timothy G. Shelhart, West Henrietta, NY (US); Timothy D. Slattery, Rochester, NY (US); Joseph M. Ferrara, Jr., Webster, NY (US); Carlos M. Terrero, Ontario, NY (US); Jacob R. McCarthy, Williamson, NY (US); Roberto A. Irizarry, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 578 days.

(21) Appl. No.: 15/896,114

(22) Filed: Feb. 14, 2018

(65) Prior Publication Data

US 2019/0248130 A1 Aug. 15, 2019

(51) Int. Cl.

| | |
|---|---|
| ***G03G 15/00*** | (2006.01) |
| ***B65H 5/02*** | (2006.01) |
| ***B41F 33/00*** | (2006.01) |
| *B41J 11/00* | (2006.01) |

(52) U.S. Cl.

CPC ..... *B41F 33/00* (2013.01); *B41J 11/0095* (2013.01); *B65H 2515/702* (2013.01); *B65H 2701/1311* (2013.01); *G03G 2215/00632* (2013.01)

(58) Field of Classification Search

CPC ..... G03G 2215/00632

See application file for complete search history.

(56) References Cited

U.S. PATENT DOCUMENTS

| | | | | |
|---|---|---|---|---|
| 2,825,281 A * | 3/1958 | Heywood | B41F 21/00 101/287 |
| 3,416,860 A | 12/1968 | Mihojevich et al. | |
| 4,641,949 A * | 2/1987 | Wallace | B65H 43/02 271/258.01 |
| 5,031,896 A * | 7/1991 | Winkler | H01H 35/00 271/258.04 |
| 6,151,478 A * | 11/2000 | Katsuta | B65H 5/34 271/258.01 |

(Continued)

FOREIGN PATENT DOCUMENTS

JP 59015271 A * 1/1984 ..... G03G 15/6535

*Primary Examiner* — Manish S Shah
*Assistant Examiner* — Ruben C Parco, Jr.
(74) *Attorney, Agent, or Firm* — Gibb & Riley, LLC

(57) ABSTRACT

Devices include electrically conductive elements contacting a vacuum belt, and a voltage source connected to the electrically conductive elements. The electrically conductive elements form an electrical circuit from the voltage source, through the belt, and back to the voltage source. The electrically conductive elements are positioned so that they are separated from the belt when the belt moves the sheets of media between the electrically conductive elements and the belt. A processor is capable of identifying leading edges of the sheets of media on the belt (when voltage of the electrical circuit changes from a relatively higher voltage to a relatively lower voltage) and identifying trailing edges of the sheets of media on the belt (when the voltage of the electrical circuit changes from the relatively lower voltage back to the relatively higher voltage).

17 Claims, 6 Drawing Sheets

(56) References Cited

U.S. PATENT DOCUMENTS

| | | | | |
|---|---|---|---|---|
| 6,300,968 | B1 | 10/2001 | Kerxhalli et al. | |
| 6,393,237 | B1 * | 5/2002 | Shindo | G03G 15/0291 399/171 |
| 6,406,017 | B1 * | 6/2002 | Yaneda | B65H 5/224 271/196 |
| 6,467,900 | B1 * | 10/2002 | Askren | B41J 11/0095 347/104 |
| 6,651,980 | B2 | 11/2003 | Isemura et al. | |
| 7,988,150 | B2 | 8/2011 | Harney et al. | |
| 2001/0002953 | A1 * | 6/2001 | Sato | G03G 15/0194 399/284 |
| 2002/0044787 | A1 * | 4/2002 | Katayanagi | G03G 15/0131 399/49 |
| 2005/0077674 | A1 * | 4/2005 | Yamamoto | B65H 7/02 271/265.01 |
| 2005/0195264 | A1 * | 9/2005 | Sootome | B41J 11/007 347/104 |
| 2011/0044745 | A1 * | 2/2011 | Takano | G03G 15/657 399/400 |
| 2011/0293346 | A1 * | 12/2011 | Sato | B41J 11/0085 400/578 |
| 2015/0336406 | A1 * | 11/2015 | Hobo | B41J 13/103 347/104 |
| 2016/0067985 | A1 * | 3/2016 | Akahori | B41J 13/0018 347/16 |

* cited by examiner

SHEET DETECTION CIRCUIT USING ELECTRICAL ELEMENTS CONTACTING CONDUCTIVE VACUUM BELT

BACKGROUND

Systems and methods herein generally relate to belt transport systems that transport sheets of media, and to sheet detection systems; and, more particularly to a sheet detection circuit that uses electrical elements contacting a conductive vacuum belt.

Vacuum belts are often used to transport sheets of material, such as sheets of paper, plastic, transparencies, card stock, etc., within printing devices (such as electrostatic printers, inkjet printers, etc.). Such vacuum belts have holes, openings, perforations, etc., that are open to a vacuum manifold through which air is drawn. The vacuum manifolds draws in air through the perforations, which causes the sheets to remain on the belt, even as the belt moves at relatively high speeds. The belt is generally supported between two or more rollers (one or more of which can be driven) and are commonly used to transport sheets from a storage area (e.g., paper tray) or sheet cutting device (when utilizing webs of material) to a printing engine.

In addition, printers improve performance by detecting locations of the leading and trailing edges of the sheets of media. For example, this allows the printing engine to properly align printing on the sheet of media, and avoids applying marking materials (e.g., inks, toners, etc.) to the belt itself. Common sheet edge detection devices include optical sensors (e.g., laser sensors) or similar devices; however, such optical sensors can be expensive and difficult to align/focus, and they may not always detect the sheet edges properly, especially when there is little difference between the color, or appearance, of the sheet and the belt.

SUMMARY

Apparatuses herein include components of, or an entire, printing device; and such devices include (among other components) a printing engine, a sheet supply, a belt (such as a conductive vacuum belt) positioned to move sheets of media from the sheet supply to the printing engine, etc.

Further, such devices include electrically conductive elements (such as electrically conductive wheels, contacts, leads, arms, bars, etc.) contacting the belt. Additionally, these devices include a voltage source connected to the electrically conductive elements. The sheets of media contact the outer surface of the belt, and the electrically conductive elements contact the same outer surface of the belt. The electrically conductive elements are in a fixed position adjacent the belt, and the electrically conductive elements maintain contact with belt as the belt moves by the electrically conductive elements. Further, these electrically conductive elements are positioned so that they are separated from (temporarily disconnected from or insulated from) the belt by the sheets of media on the belt (e.g., when the belt moves the sheets of media between the electrically conductive elements and the belt).

Also, a voltage detector is operatively connected to the voltage source. The voltage source, the electrically conductive elements, the belt, and the voltage detector form an electrical circuit (potentially with a common ground connection). The voltage detector is capable of detecting the voltage of the electrical circuit.

Further, a processor is operatively connected to the voltage detector. The processor is capable of identifying leading edges of the sheets of media on the belt (when voltage of the electrical circuit changes from a relatively higher voltage to a relatively lower voltage) and identifying trailing edges of the sheets of media on the belt (when the voltage of the electrical circuit changes from the relatively lower voltage back to the relatively higher voltage). The relatively higher voltage can be, for example, at least two times the relatively lower voltage. Thus, the processor is capable of identifying positions of the sheets of media based on these leading and trailing edges.

These and other features are described in, or are apparent from, the following detailed description.

BRIEF DESCRIPTION OF THE DRAWINGS

Various exemplary systems and methods are described in detail below, with reference to the attached drawing figures, in which:

FIGS. 6-7A are side view schematic diagrams of an electrical circuit formed with a belt of devices herein;

DETAILED DESCRIPTION

As mentioned above, optical sensors used to detect leading and trailing sheet edges can be expensive and difficult to align/focus, and they may not always detect the sheet edges properly, especially when there is little difference between the color, or appearance, of the sheet and the belt.

Figure 1A:
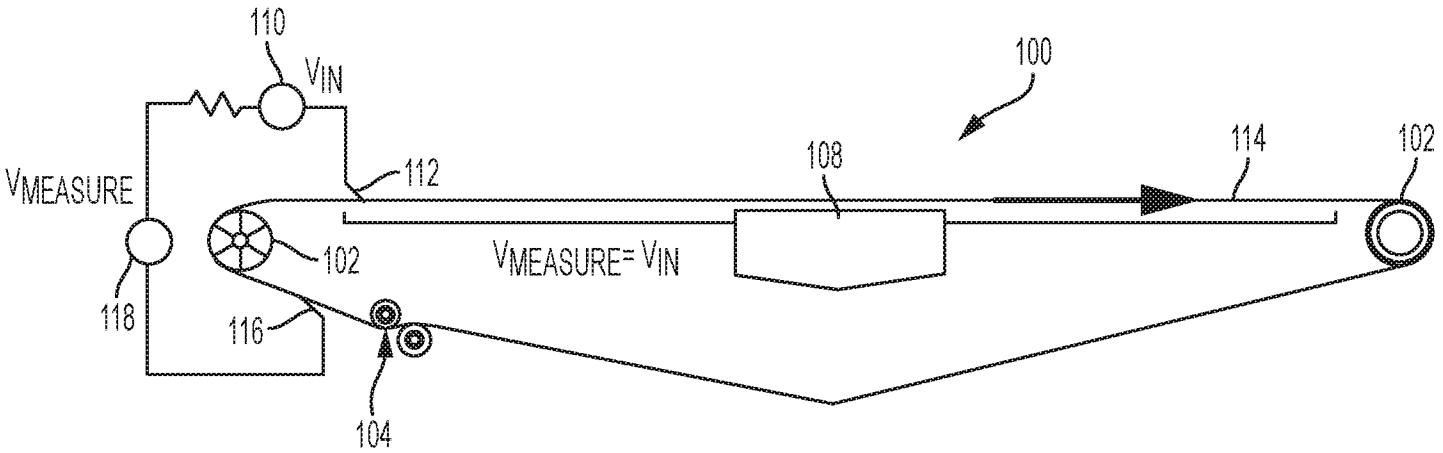
FIGS. 1A-3 are side view schematic diagrams of an electrical circuit formed with a belt of devices herein.

As shown for example in FIG. 1A, apparatuses herein include components of, or an entire, printing device; and such devices include a media path 100 having (among other components) a belt 114 (such as a conductive vacuum or non-vacuum belt) positioned to move sheets of media 106 from a sheet supply to a printing engine, etc. (and is therefore sometimes referred to as a marker transport belt).

The belt is supported on roller 102 (one or more of which is driven) and is kept in tension by one or more sets of biased tensioning rollers 104. Additionally, a vacuum system/manifold 108 draws air through perforations in the belt 114, thereby keeping sheets of media from sliding off the belt 114. More details of an exemplary printing device are discussed below with respect to FIG. 8.

At least the outer surface of the exemplary belt 114 is electrically conductive (the inner surface of the belt 114 is adjacent the vacuum manifold 108, and the outer surface of the belt 114 is opposite the inner surface). More specifically, the belt can include multiple layers, and one or more of such layers can be electrically conductive or partially conductive. For example, the outer layer of the belt 114 can be formed of multiple materials, such as one or more flexible durable structural material layers (including cloths, polymers, synthetics, rubbers, woven metal or alloy wires, and/or carbon fibers, etc.). If the belt material is not itself electrically conductive, one or more conductive materials such as metals, alloys, conductive carbon materials, polysilicon, etc., can be added to the belt to make at least the outer surface conductive.

Figure 1B:
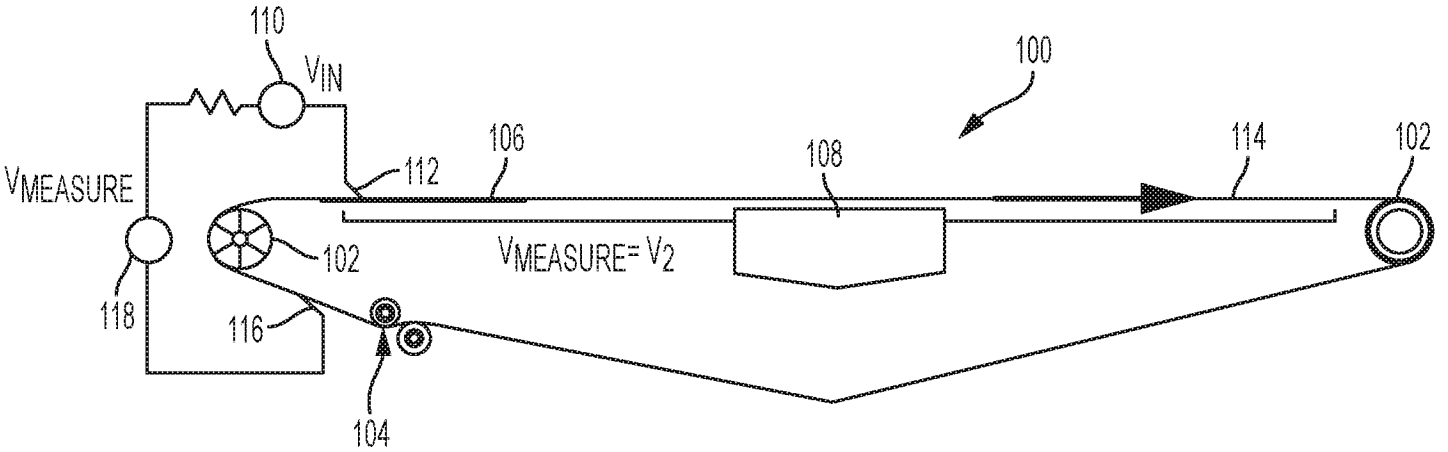

Further, as shown in FIG. 1A, such a media path 100 includes electrically conductive elements 112, 116 (such as electrically conductive wheels, contacts, leads, arms, bars, etc., some of which are discussed in greater detail below) contacting the belt 114. Additionally, these devices include a voltage source 110 connected to one or more of the electrically conductive elements 112, 116. The electrically conductive elements 112, 116 form an electrical circuit from the voltage source 110, through the belt 114, through a voltage detector 118, and back to the voltage source 110 (and such a circuit can potentially include a common ground). As shown in FIG. 1B, in the media path 100, sheets of media 106 contact the outer surface of the belt 114, and the electrically conductive elements 112, 116 contact the same surface of the belt 114.

The electrically conductive elements 112, 116 are in a fixed position adjacent the belt 114, and the electrically conductive elements 112, 116 maintain contact with belt 114 as the belt 114 moves by the electrically conductive elements 112, 116 (as shown in FIG. 1A). However, as shown in FIG. 1B, these electrically conductive elements 112, 116 are positioned so that they are separated from (temporarily disconnected from or insulated from) the belt 114 by the sheets of media 106 on the belt 114 (e.g., when the belt 114 moves the sheets of media 106 between the electrically conductive elements 112, 116 and the belt 114). Therefore, FIG. 1A illustrates the closed (electrically continuous) circuit 110-118, while FIG. 1B illustrates an open circuit 110-118 that is interrupted by the sheet of media 106 (when a circuit is open, no current flows). Also, the voltage detector 118 (that is operatively connected to the voltage source 110) is capable of detecting the voltage/current of the electrical circuit 110-118.

Figure 2A:
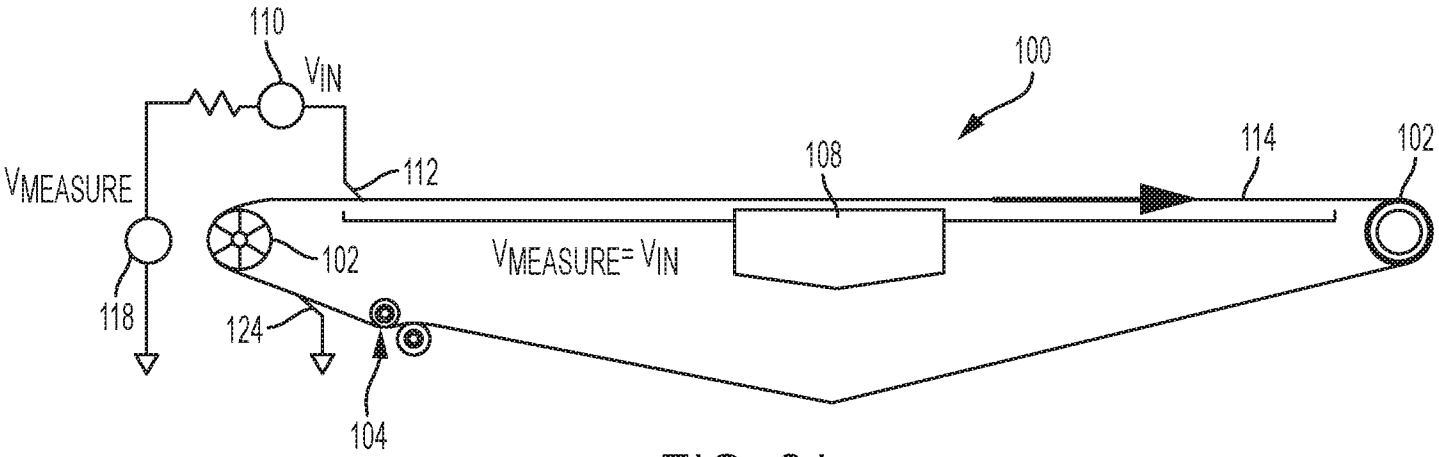
Figure 2B:
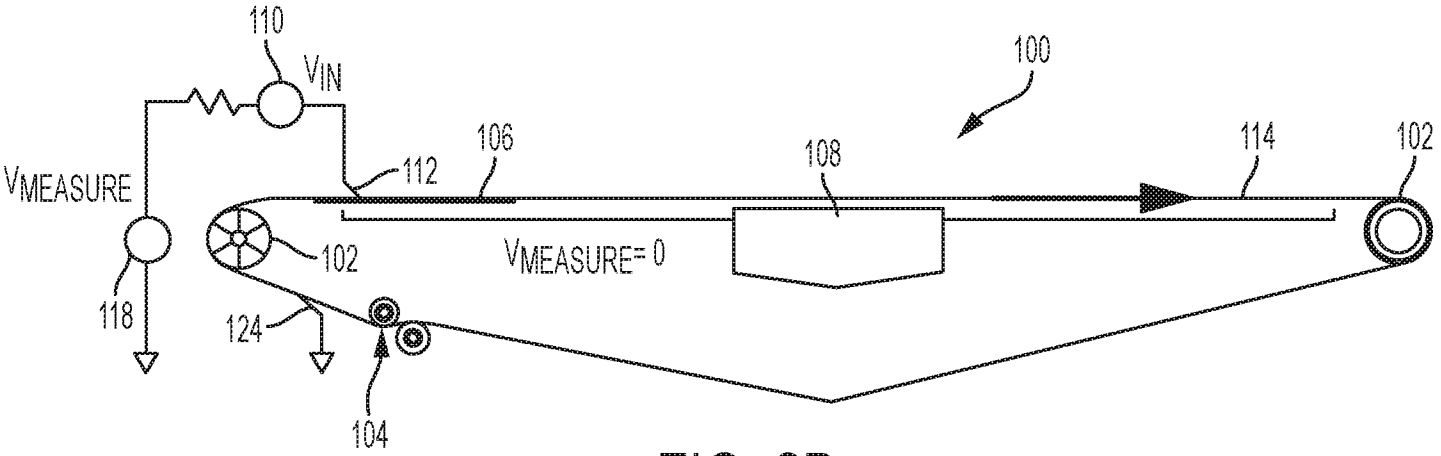

FIGS. 2A-2B illustrate the same media path 100 structure shown in FIGS. 1A-1B (and the same identification numbers are used to illustrate the same or similar elements throughout this disclosure), except that the circuit in FIGS. 2A-2B is formed through a common ground (represented in the drawings by an inverted triangle). Therefore, the voltage detector 118 is connected to the common ground, as is one of the electrical elements (124). As is understood by those ordinarily skilled in the art, the common ground (that can be included at various points throughout the printing device) directly or indirectly completes the circuit 110-118, and is therefore electrically equivalent to the direct connection (wire) 116 from the belt 114 to the voltage detector 118.

Figure 3:
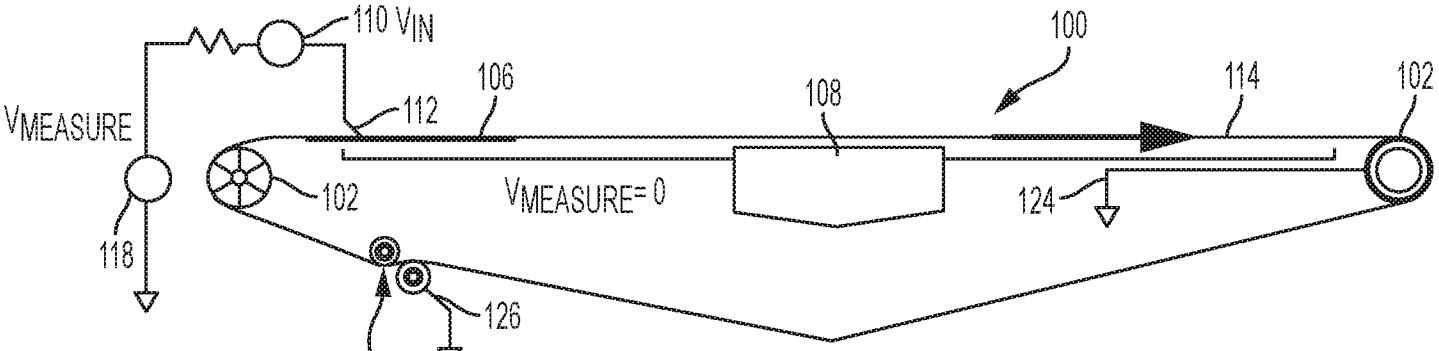

As with FIGS. 1A-1B, FIG. 2A illustrates the closed (electrically continuous) circuit 110-118, while FIG. 2B illustrates an open circuit 110-118 that is interrupted by the sheet of media 106. In a similar manner, FIG. 3 illustrates an alternative media path 100 structure where the electrical element 116 is omitted, and instead one or more of the electrically conductive rollers 102 and/or the tensioning rollers 104 are grounded (as represented by electrical elements 126 in FIG. 3).

The voltages detected by the voltage detector 118 can be any voltage level appropriate for the device in question (e.g., 0V-110V). Also, the lower voltage detected by the voltage detector 118 when a sheet of media 106 insulates the conduct element 112 from the belt 114 (e.g., an open circuit condition) can be 0V, or can be above 0V, so long as the lower voltage is detectably lower than the higher voltage that occurs when the conductive element 112 is in contact with the belt 114 (e.g., closed circuit condition). In other words, the open circuit condition does not necessarily need to cause a 0V reading by the voltage detector 118; but instead, the open circuit condition only should produce a voltage/current reduction of sufficient magnitude to be measured. In one example, the minimum difference between the lower and higher voltage can be to set the relatively higher voltage to be at least two times the relatively lower voltage (e.g., 2V vs. 4V, etc.).

Thus, the marker transport belt 114 is conductive and makes up part of an electrical circuit 110-118 that is opened by a passing sheet 106. In one example, a small voltage can be applied (~5V), and for the closed circuit 110-118, the voltage measured by the voltage detector 118 is approximately the same as the input. When the circuit 110-118 is opened by the paper 106, the voltage detector 118 senses a voltage drop in the circuit 110-118 (potentially to zero volts). In this way one of the elements 112 (in conjunction with the passing sheet 106) acts as a switch to open or close the circuit 110-118. The other conductive element 116 that completes the circuit 110-118 can contact any area of the belt where the sheet does not pass, such as the extreme sides of the belt 114, or the underside of the belt 114.

Figure 4:
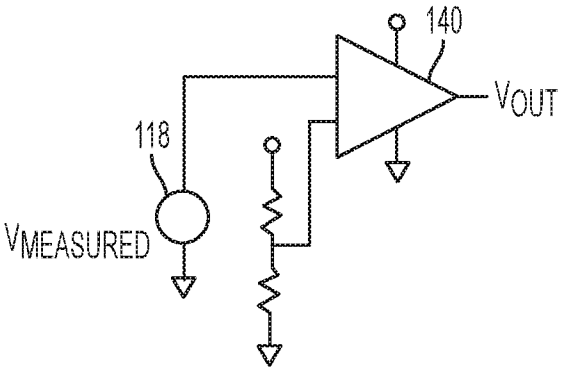
FIG. 4 is a schematic diagram illustrating an exemplary voltage detector circuit herein.

While the foregoing disclosure describes that the passing sheet 106 will cause a relatively lower voltage (as an uneven analog signal) that is detected by the voltage detector 118, it is more common for the presence of a sheet to be represented by a relatively higher (digital square wave) voltage signal; while the absence of a sheet is represented by relatively lower voltage. Therefore, the analog signal output by the voltage detector 118 can be converted to the more common digital square wave signal used for leading and trailing paper edge detection. FIG. 4 illustrates one exemplary circuit that uses an operational amplifier 140 connected to ground through resistors, that receives the analog signal ($V_{measured}$) output by the voltage detector 118, and outputs an inverted square wave signal ($V_{out}$).

Figure 5:
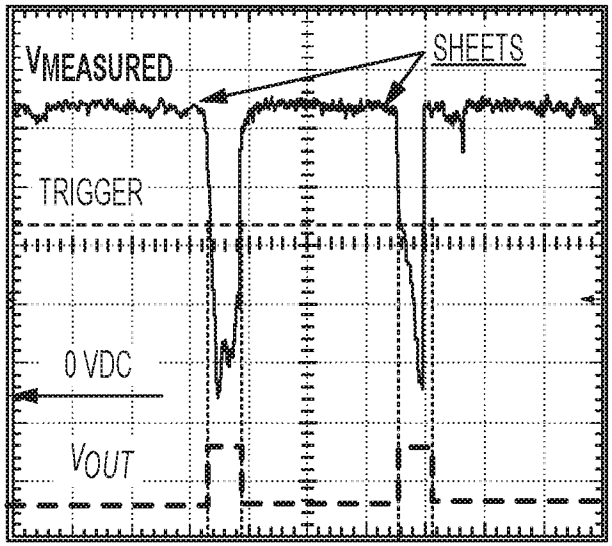
FIG. 5 is graph illustrating various voltages and signals produced by devices herein.

FIG. 5 illustrates the relationship between the analog signal ($V_{measured}$) and this square wave signal ($V_{out}$) output by the circuit shown in FIG. 4, which forms a paper edge signal. Therefore, as can be seen in FIG. 5, when the voltage detector 118 senses a reduction in voltage, the circuit shown in FIG. 4 outputs a square wave increased voltage level ($V_{out}$). As shown in FIG. 5, the rising edge of the square wave voltage signal ($V_{out}$) represents the leading edge of the sheet of media 106 contacting the conductive element 112, while the falling edge of the square wave voltage signal ($V_{out}$) represents the trailing edge of the sheet of media 106 contacting the conductive element 112.

Figure 6:
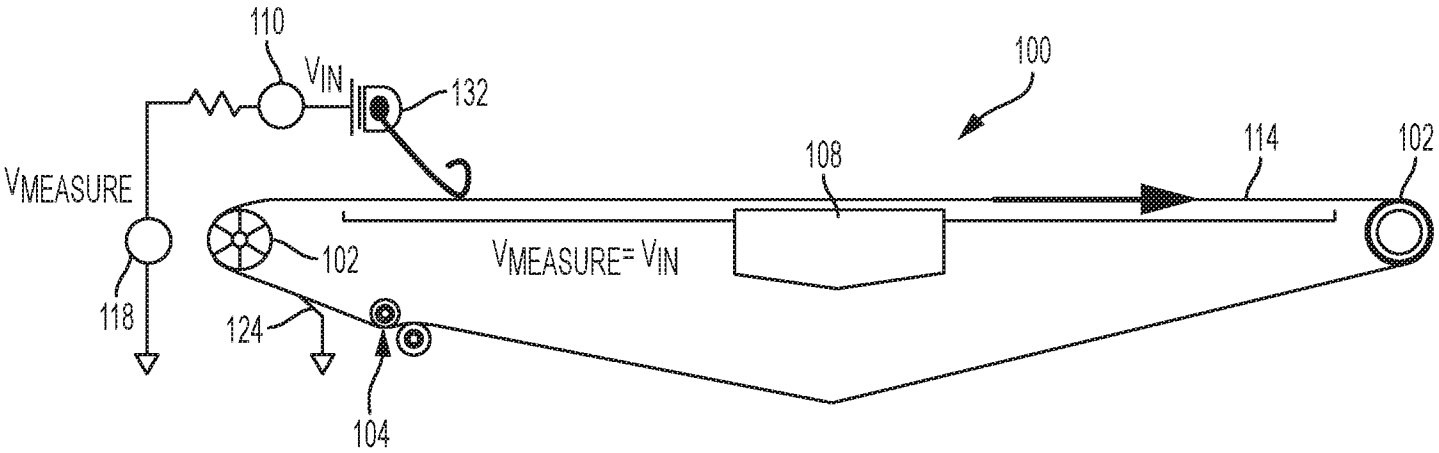

The switch 112 that is interrupted by the paper 106 could be a roller, conductive brush or wire. More specifically, FIG. 6 illustrates a similar media path 100 that includes a switch 132 (another electrically conductive element, similar the previously discussed elements 112 used in the circuit 110-118) that can rest on the belt 114 under its own weight, or can be biased against the belt 114 with a slight spring load.

Figure 7A:
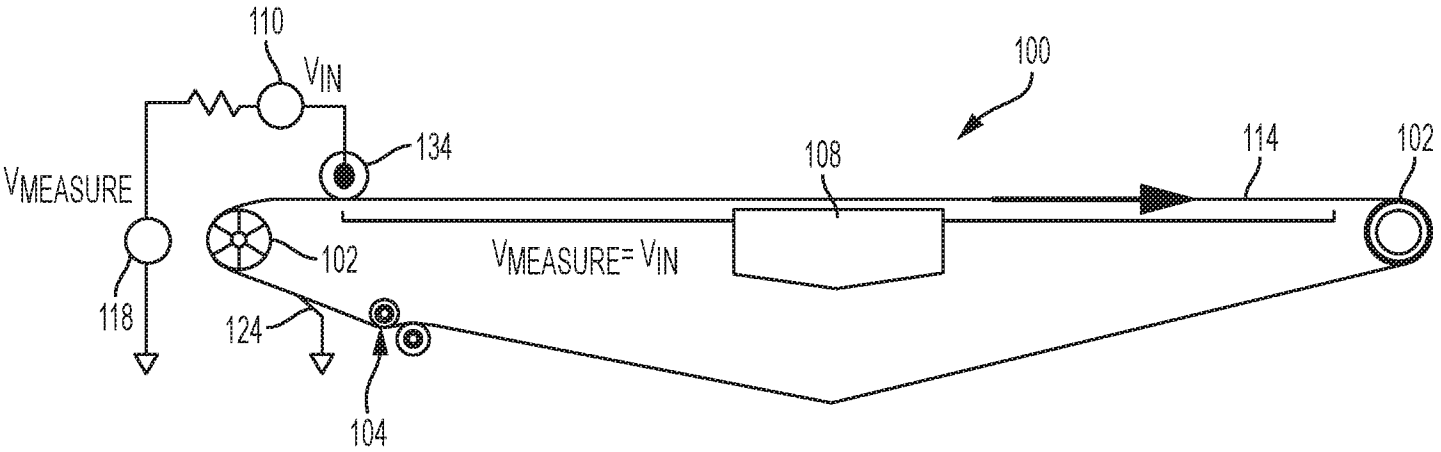
Figure 7B:
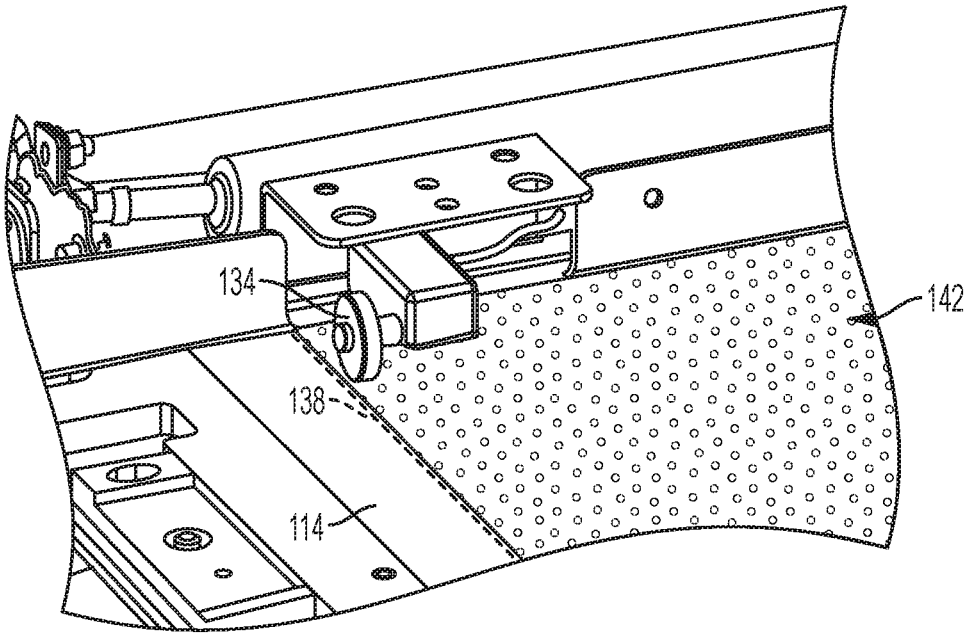
FIGS. 7B-7C are perspective view schematic diagrams of an electrically conductive wheel of devices herein.
Figure 7C:
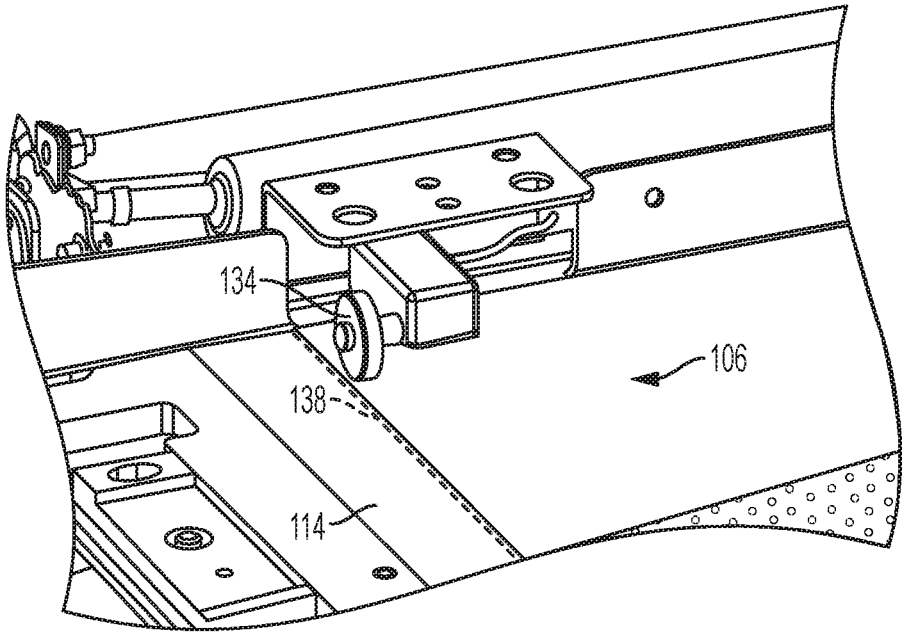

As another alternative media path 100 structure, FIGS. 7A-7C illustrate a conductive roller 134 that, again, is another electrically conductive element, similar the previously discussed elements 112, 132 used in the circuit 110-118. FIG. 7B is a perspective schematic showing the conductive roller 134 contacting the belt 114 (and thereby completing the circuit); while FIG. 7C is a similar image showing a sheet of media 106 interrupting the circuit by separating and insulating the conductive roller 134 from the belt 114. FIGS. 7B and 7C also illustrate the registration line 138 to which sheet of media are constrained, and illustrate the perforations 142 in the belt 114 through which the vacuum manifold 108 draws air.

Because the leading and trailing edge detection is performed by the sheet making contact with one of the conductive elements 112, the devices herein can detect any media (regardless of color), and are implemented on existing printers with minimal hardware changes and no changes to the belt. Further, these devices are lower cost relative the optical detector and do not alter existing software, as these devices output the same square wave signal ($V_{out}$) as optical sensor.

Figure 8:
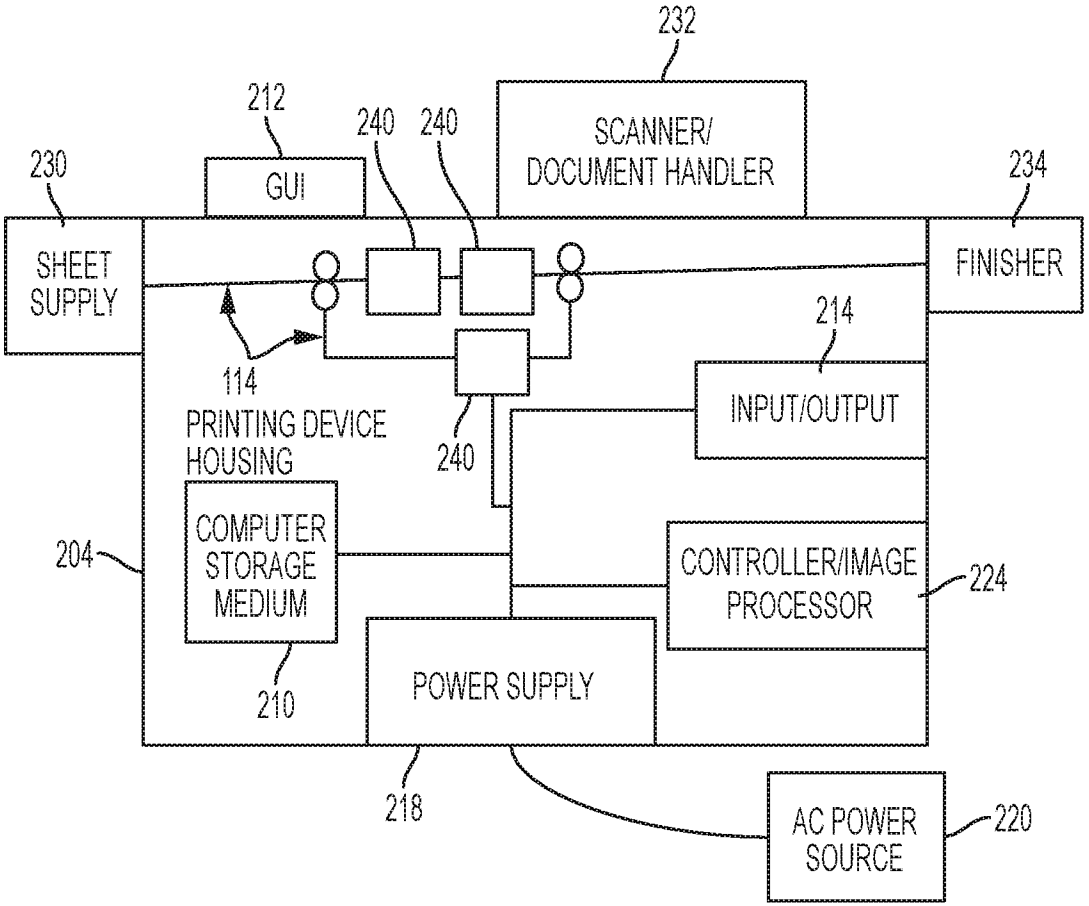
FIG. 8 is a schematic diagram illustrating devices herein.

FIG. 8 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 8, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use marking material, and are operatively connected to a specialized image processor 224 (that is different from a general purpose computer because it is specialized for processing image data), the aforementioned media path 100 (that includes the circuit 110-118 discussed above) positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

Further, the processor 224 is operatively connected to the voltage detector 118. The processor 224 is capable of identifying leading edges of the sheets of media 106 on the belt 114 (when voltage of the electrical circuit changes from a relatively higher voltage to a relatively lower voltage) and identifying trailing edges of the sheets of media 106 on the belt 114 (when the voltage of the electrical circuit changes from the relatively lower voltage back to the relatively higher voltage). The relatively higher voltage can be at least two times the relatively lower voltage. Thus, the processor 224 is capable of identifying positions of the sheets of media 106 based on the leading edges and the trailing edges.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

an electrically conductive belt capable of moving sheets of media;

electrically conductive brushes contacting said electrically conductive belt, wherein said electrically conductive brushes rest on said electrically conductive belt, said electrically conductive brushes are in a fixed position adjacent said electrically conductive belt, and said electrically conductive brushes maintain contact with electrically conductive belt as said electrically conductive belt moves by said electrically conductive brushes, wherein a first of said electrically conductive brushes is positioned to be separated from said electrically conductive belt by said sheets of media on said electrically conductive belt and a second of said electrically conductive brushes is positioned to contact said electrically conductive belt where said sheets of media do not pass;

a voltage source connected to said electrically conductive brushes;

a voltage detector operatively connected to said voltage source, wherein said voltage source, said electrically conductive brushes, said electrically conductive belt, and said voltage detector form an electrical circuit, and wherein said voltage detector is capable of detecting a voltage of said electrical circuit; and a processor operatively connected to said voltage detector, wherein said processor is capable of identifying leading edges of said sheets of media on said electrically conductive belt when voltage of said electrical circuit changes from a relatively higher voltage to a relatively lower voltage, and identifying trailing edges of said sheets of media on said electrically conductive belt when said voltage of said electrical circuit changes from said relatively lower voltage back to said relatively higher voltage.

2. The apparatus according to claim 1, wherein said relatively higher voltage is at least two times said relatively lower voltage.

3. The apparatus according to claim 1, wherein said sheets of media contact a surface of said electrically conductive belt, and said first of said electrically conductive brushes contacts said surface of said electrically conductive belt.

4. The apparatus according to claim 1, wherein said processor is capable of identifying positions of said sheets of media based on said leading edges and said trailing edges.

5. The apparatus according to claim 1, wherein said electrically conductive belt comprises an electrically conductive vacuum belt.

6. The apparatus according to claim 1, further comprising a printing engine positioned to receive said sheets of media from said electrically conductive belt.

7. An apparatus comprising:

an electrically conductive belt capable of moving sheets of media;

electrically conductive brushes contacting said electrically conductive belt, wherein said electrically conductive brushes rest on said electrically conductive belt, said electrically conductive brushes are in a fixed position adjacent said electrically conductive belt, and said electrically conductive brushes maintain contact with electrically conductive belt as said electrically conductive belt moves by said electrically conductive brushes, wherein at least a first of said electrically conductive brushes is positioned to be separated from said electrically conductive belt by said sheets of media on said electrically conductive belt and at least a second of said electrically conductive brushes is positioned to contact said electrically conductive belt where said sheets of media do not pass;

a voltage source connected to said electrically conductive brushes;

a voltage detector operatively connected to said voltage source, wherein said voltage source, said electrically conductive brushes, said electrically conductive belt, and said voltage detector form an electrical circuit, and wherein said voltage detector is capable of detecting a voltage of said electrical circuit; and a processor operatively connected to said voltage detector, wherein said processor is capable of identifying leading edges of said sheets of media on said electrically conductive belt when voltage of said electrical circuit changes from a relatively higher voltage to a relatively lower voltage, and identifying trailing edges of said sheets of media on said electrically conductive belt when said voltage of said electrical circuit changes from said relatively lower voltage back to said relatively higher voltage.

8. The apparatus according to claim 7, wherein said relatively higher voltage is at least two times said relatively lower voltage.

9. The apparatus according to claim 7, wherein said sheets of media contact a surface of said electrically conductive belt, and said first of said electrically conductive brushes contacts said surface of said electrically conductive belt.

10. The apparatus according to claim 7, wherein said processor is capable of identifying positions of said sheets of media based on said leading edges and said trailing edges.

11. The apparatus according to claim 7, wherein said electrically conductive belt comprises an electrically conductive vacuum belt.

12. The apparatus according to claim 7, further comprising a printing engine positioned to receive said sheets of media from said electrically conductive belt.

13. An apparatus comprising:

an electrically conductive belt capable of moving sheets of media;

electrically conductive brushes contacting said electrically conductive belt, wherein said electrically conductive brushes rest on said electrically conductive belt, said electrically conductive brushes are in a fixed position adjacent said electrically conductive belt, and said electrically conductive brushes maintain contact with electrically conductive belt as said electrically conductive belt moves by said electrically conductive brushes, wherein at least a first of said electrically conductive brushes is positioned to be separated from said electrically conductive belt by said sheets of media on said electrically conductive belt and at least a second of said electrically conductive brushes is positioned to contact an underside of said electrically conductive belt where said sheets of media do not pass;

a voltage source connected to said electrically conductive brushes;

a voltage detector operatively connected to said voltage source, wherein said voltage source, said electrically conductive brushes, said electrically conductive belt, and said voltage detector form an electrical circuit, and wherein said voltage detector is capable of detecting a voltage of said electrical circuit; and a processor operatively connected to said voltage detector, wherein said processor is capable of identifying leading edges of said sheets of media on said electrically conductive belt when voltage of said electrical circuit changes from a relatively higher voltage to a relatively lower voltage, and identifying trailing edges of said sheets of media on said electrically conductive belt when said voltage of said electrical circuit changes from said relatively lower voltage back to said relatively higher voltage.

14. The apparatus according to claim 13, wherein said relatively higher voltage is at least two times said relatively lower voltage.

15. The apparatus according to claim 13, wherein said sheets of media contact a surface of said electrically conductive belt, and said first of said electrically conductive brushes contacts said surface of said electrically conductive belt.

16. The apparatus according to claim 13, wherein said processor is capable of identifying positions of said sheets of media based on said leading edges and said trailing edges.

17. The apparatus according to claim 13, wherein said electrically conductive belt comprises an electrically conductive vacuum belt.

* * * * *